US008813992B2

(12) United States Patent
Chitayat et al.

(10) Patent No.: US 8,813,992 B2
(45) Date of Patent: Aug. 26, 2014

(54) COUNTERTOP COMPOST COLLECTOR

(75) Inventors: David Dennys Chitayat, Shanghai (CN); Heather Tomasetti, Shanghai (CN); Pieter Schouten, Berkeley, CA (US)

(73) Assignee: Genimex Jersey Ltd., Shanghai (CN)

( * ) Notice: Subject to any disclaimer, the term of this patent is extended or adjusted under 35 U.S.C. 154(b) by 288 days.

(21) Appl. No.: 13/041,383

(22) Filed: Mar. 5, 2011

(65) Prior Publication Data

US 2012/0222281 A1 Sep. 6, 2012

(51) Int. Cl.
*B65D 25/18* (2006.01)
*B65F 1/06* (2006.01)
*B65F 1/14* (2006.01)

(52) U.S. Cl.
CPC ..... *B65F 1/06* (2013.01); *B65F 2001/1489* (2013.01); *Y10S 220/9081* (2013.01)
USPC ..... 220/495.04; 220/495.01; 220/908.1

(58) Field of Classification Search
USPC ..... 29/428; 220/495.03, 495.08, 220/495.04–495.06, 495.01, 908.1, 908.2, 220/625, 908, 914; 71/9
See application file for complete search history.

(56) References Cited

U.S. PATENT DOCUMENTS 4,294,379 A 10/1981 Bard
4,630,752 A * 12/1986 DeMars ..... 220/495.08
4,765,579 A * 8/1988 Robbins et al. ..... 248/101
4,955,566 A * 9/1990 Bolich ..... 248/101
5,031,796 A * 7/1991 Schafer et al. ..... 220/571
5,072,852 A * 12/1991 Smith et al. ..... 220/495.09
5,156,290 A * 10/1992 Rodrigues ..... 220/87.1
5,265,755 A * 11/1993 McArthur et al. ..... 220/601
5,700,689 A 12/1997 Wuster
5,816,431 A * 10/1998 Giannopoulos ..... 220/495.11
6,000,571 A 12/1999 Brooks et al.
6,223,927 B1 * 5/2001 Rand ..... 220/495.06
7,438,199 B1 10/2008 Tidrick
7,543,716 B2 * 6/2009 Lin ..... 220/495.11
7,712,623 B2 5/2010 Wentz et al.
2002/0003144 A1 * 1/2002 Grimes ..... 220/625
2004/0195244 A1 * 10/2004 Joseph ..... 220/495.04
2007/0228046 A1 * 10/2007 Bastioli et al. ..... 220/495.04
2008/0124791 A1 5/2008 Bucci
2008/0220513 A1 9/2008 Bucci
2009/0179034 A1 * 7/2009 Olson ..... 220/495.01
2010/0193534 A1 * 8/2010 Roberts et al. ..... 220/810

* cited by examiner

*Primary Examiner* — Fenn Mathew
*Assistant Examiner* — Robert Stodola
(74) *Attorney, Agent, or Firm* — Patent Law Offices of Michael E. Woods; Michael E. Woods

(57) ABSTRACT

A method for collecting organic waste in a collection bag, the method including a) disposing the collection bag within a volume of a collection device, the collection device having a side wall enclosing the volume and defining a top opening and bottom opening wherein a plurality of vertically extending air channels are formed between the collection bag and the side wall responsive to a structure extending into the volume from the side wall interacting with the collection bag; b) supporting a bottom of the collection bag on a bottom joined to the side wall with the bottom including one or more bottom orifices communicated to the vertically extending air channels; and c) retaining an opening of the collection bag in an open configuration at the top opening with one or more top orifices formed around the opening and communicated to the vertically extending air channels.

8 Claims, 9 Drawing Sheets

COUNTERTOP COMPOST COLLECTOR

BACKGROUND OF THE INVENTION

The present invention relates generally to collection of organic materials, and more specifically, but not exclusively, to a countertop compost collector for storing kitchen organic waste.

As concern about landfill space increases, worldwide interest in recycling by means of composting is growing, since composting is a process for converting decomposable organic materials into useful stable products. Increasingly there is greater attention on the need for composting organic waste generated in households.

One significant drawback for collecting green waste in a household environment is that organic waste can begin to decompose quite rapidly. Traditionally, indoor/countertop storage solutions cover and seal the contents of a "garbage" pail which decreases the oxygen supply to the contents. Putting green waste into such an environment where oxygen is limited initiates a fairly rapid anaerobic decomposition.

It is this anaerobic decomposition that creates fluids, odors, and potentially toxic bacteria that prevent acceptance of countertop/in-house collection and storage of organic waste in preparation for composting. The anaerobic decomposition is further undesirable in that the process attracts flies and other pests which can spread disease, and it is better to avoid attracting such pests into a household. Additionally, the collection and management of in-home organic waste generally requires tools and procedures that can clash with desired design and aesthetic elements.

What is needed is a compost collector that permits aesthetic accumulation and storage of household organic waste that is more sanitary, less messy, and less odiferous.

BRIEF SUMMARY OF THE INVENTION

Disclosed is a compost collector and compost collection method that permits aesthetic accumulation and storage of household organic waste that is more sanitary, less messy, and less odiferous. The following summary of the invention is provided to facilitate an understanding of some of technical features related to household collection of green waste, and is not intended to be a full description of the present invention. A full appreciation of the various aspects of the invention can be gained by taking the entire specification, claims, drawings, and abstract as a whole.

An organic material collection container for use with a collection bag, including, a continuous substantially vertical side wall, the side wall defining a volume generally matching a volume of the collection bag, the volume having a top opening and a bottom opening, the side wall having an inner wall with a plurality of substantially vertically-extending support ribs provided on the inner wall defining a plurality of vertically-extending chutes; a bottom joined to the side wall and closing the bottom opening, the bottom including one or more spacers defining one or more bottom orifices around the bottom opening with the one or more bottom orifices communicated to the chutes; a retaining rim joined to the side wall at the top opening with the retaining rim defining a perimeter length sized to generally match a perimeter length of an opening of the collection bag and wherein the top opening has a perimeter length greater than the perimeter length of the retaining rim to thereby provide one or more top orifices communicated to the chutes between the retaining rim and the inner wall; whereby a plurality of air channels are formed by the plurality of chutes when the collection bag is disposed within the volume and the opening of the collection bag is coupled to the retaining rim with the air channels communicating air flow between the one or more top orifices and the one or more bottom orifices.

A method for collecting organic waste in a collection bag, the method including a) disposing the collection bag within a volume of a collection device, the collection device having a side wall enclosing the volume and defining a top opening and bottom opening wherein a plurality of vertically extending air channels are formed between the collection bag and the side wall responsive to a structure extending into the volume from the side wall interacting with the collection bag; b) supporting a bottom of the collection bag on a bottom joined to the side wall with the bottom including one or more bottom orifices communicated to the vertically extending air channels; and c) retaining an opening of the collection bag in an open configuration at the top opening with one or more top orifices formed around the opening and communicated to the vertically extending air channels.

Embodiments of the present invention enhance air circulation around the collection bag and thereby reduce anaerobic composition of the organic waste. As such, this device is not designed as a composter but as a collection apparatus and method to gather and store organic waste for later composting. This reduces the generation of the compost fluids and odors and reduces attractiveness to pests. Further, the orifices at the top and bottom enable the collection device to appear as a more conventional collection device and not appear out-of-place in a household environment. Thus the device promotes its adoption and use.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a compost collector that permits aesthetic accumulation and storage of household organic waste that is more sanitary, less messy, and less odiferous. The following description is presented to enable one of ordinary skill in the art to make and use the invention and is provided in the context of a patent application and its requirements Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
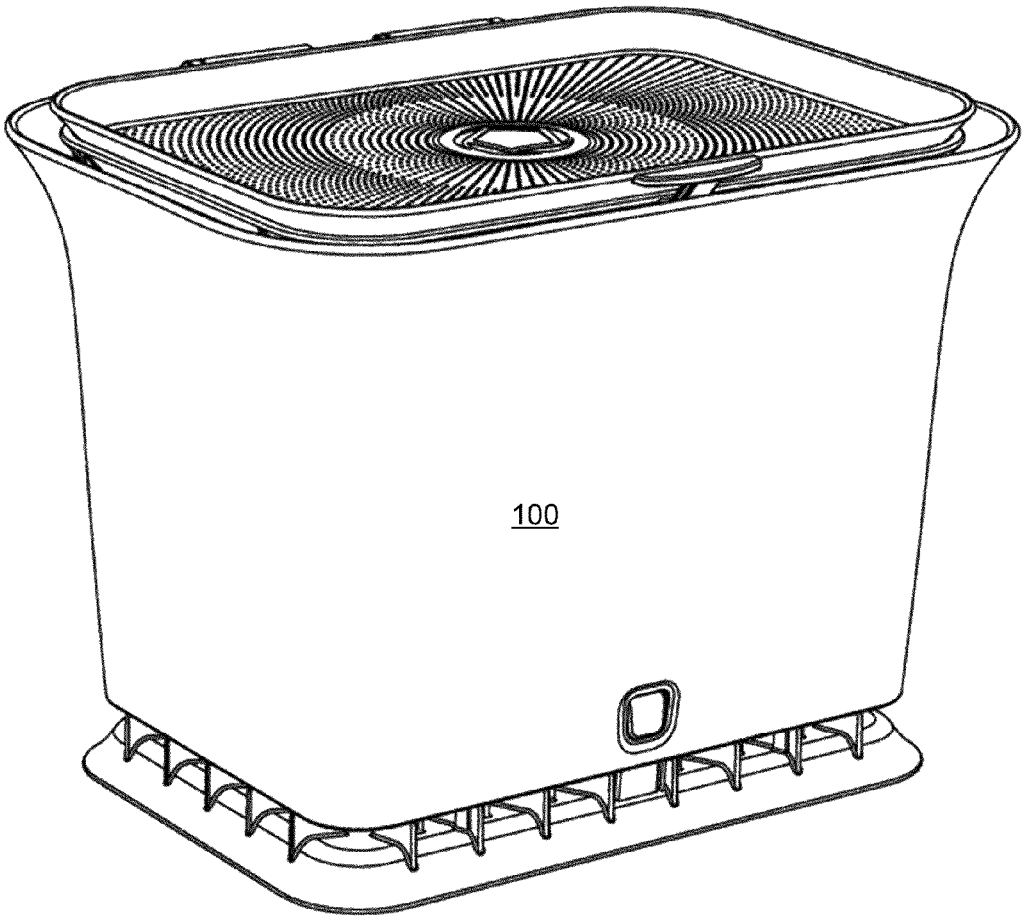
FIG. 1 illustrates a perspective view of a countertop compost collector.
Figure 2:
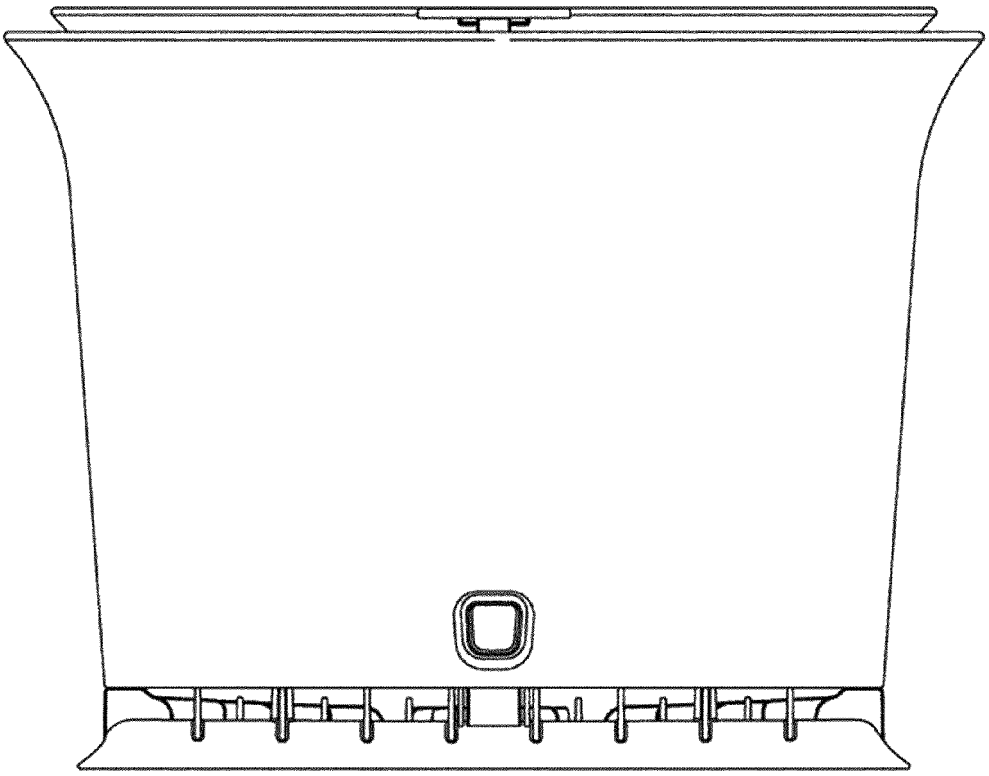
FIG. 2 illustrates a front view thereof.
Figure 3:
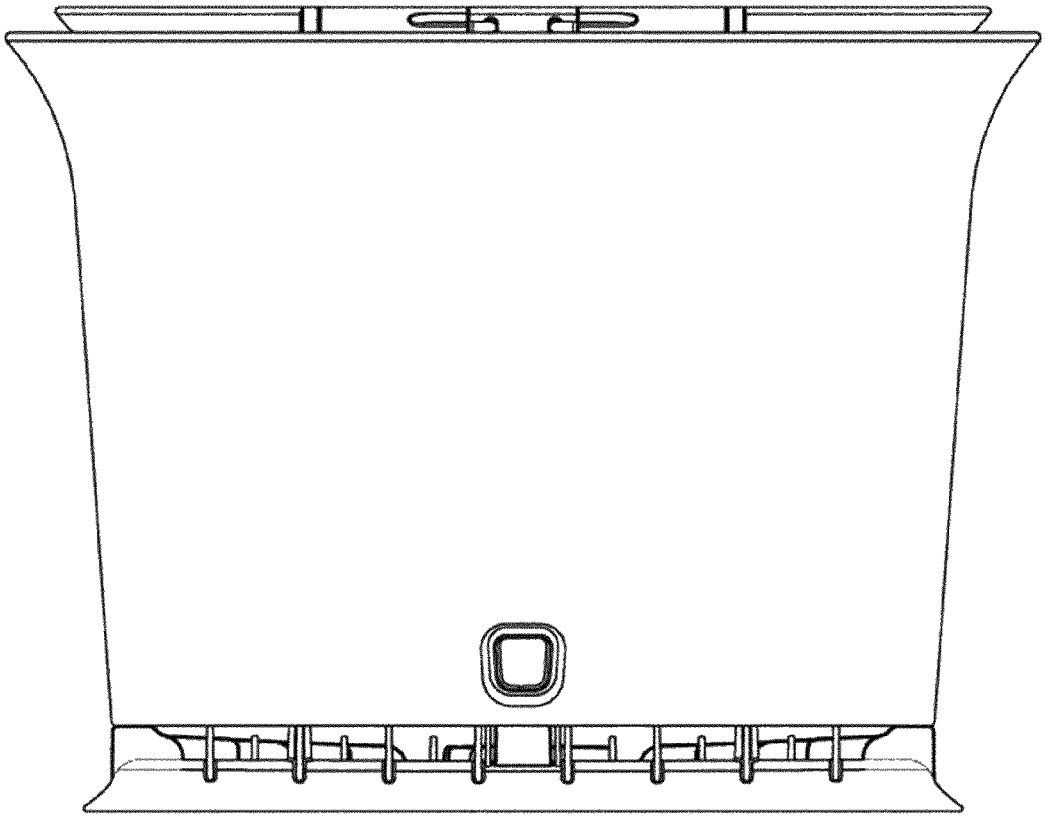
FIG. 3 illustrates a back view thereof.
Figure 4:
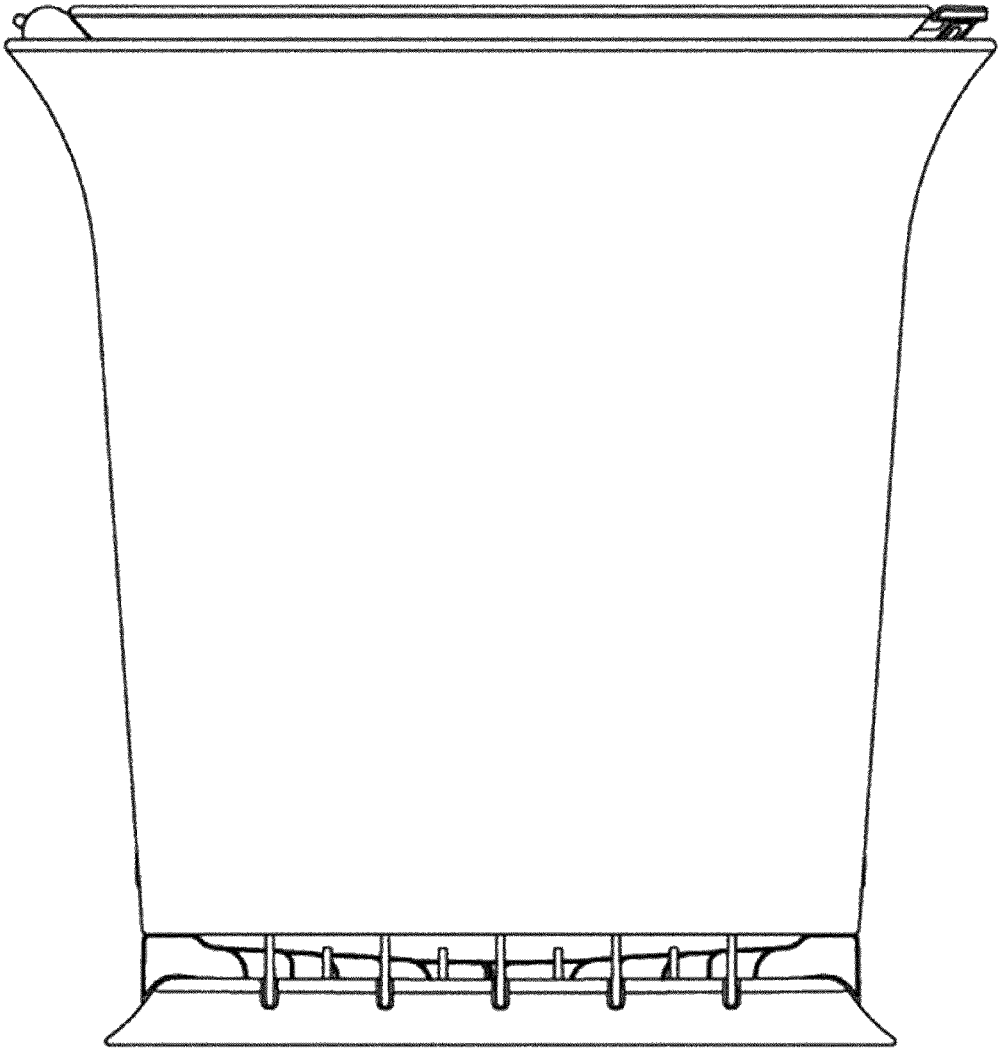
FIG. 4 illustrates a right-hand view thereof.
Figure 5:
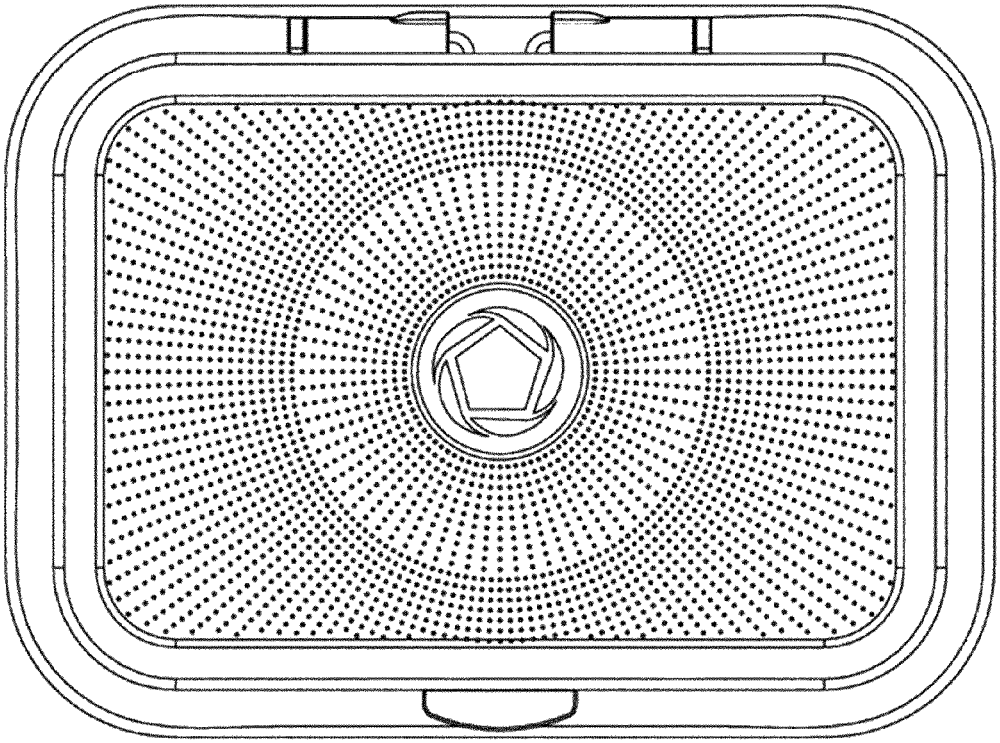
FIG. 5 illustrates a top view thereof.
Figure 6:
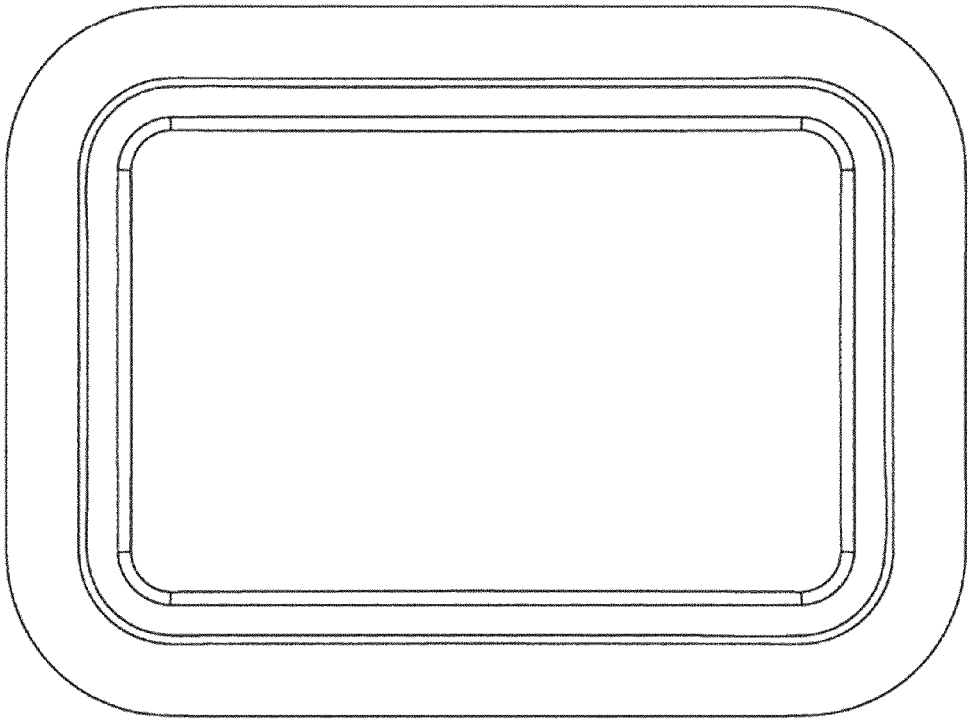
FIG. 6 illustrates a bottom view thereof.
Figure 7:
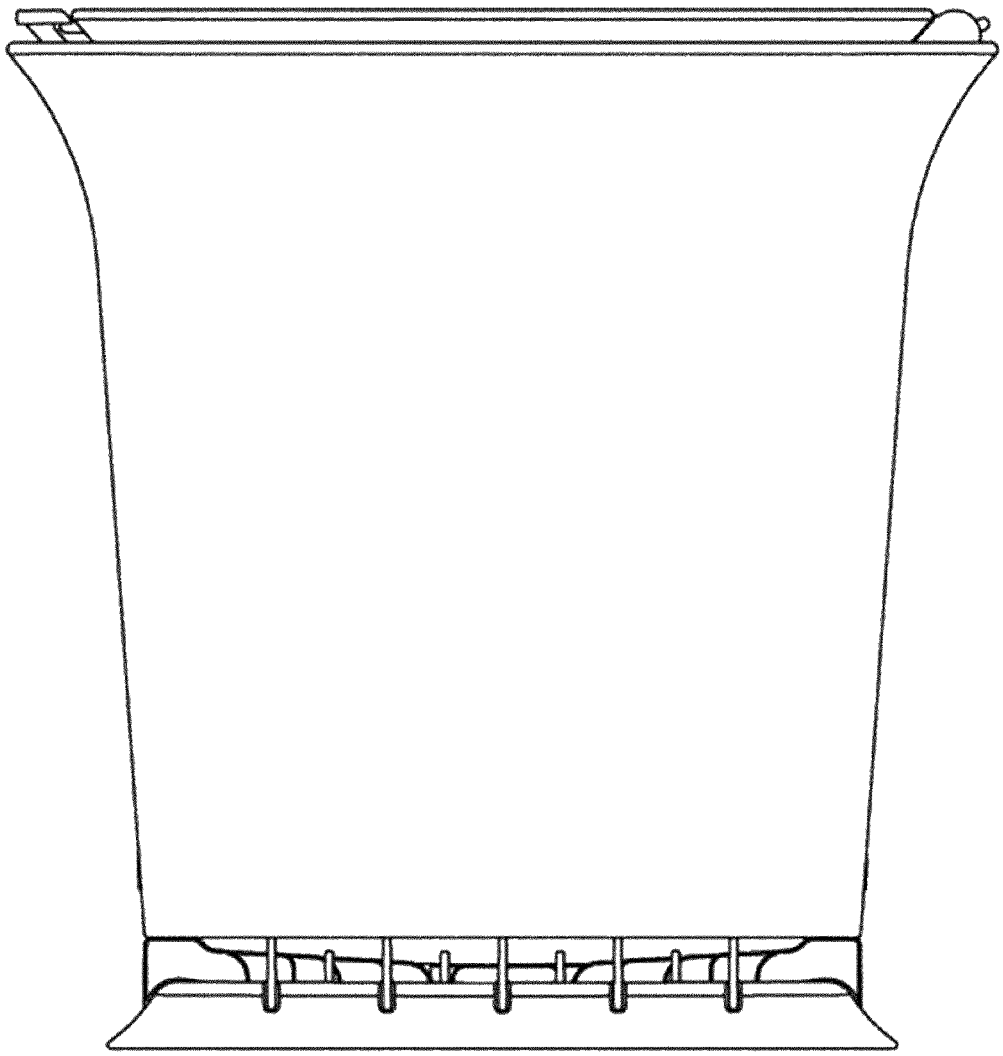
FIG. 7 illustrates a left-hand view thereof.

FIG. 1 illustrates a perspective view of a countertop compost collector 100. FIG. 2 illustrates a front view thereof; FIG. 3 illustrates a back view thereof; FIG. 4 illustrates a right-hand view thereof; FIG. 5 illustrates a top view thereof; FIG. 6 illustrates a bottom view thereof; and FIG. 7 illustrates a left-hand view thereof.

Figure 8:
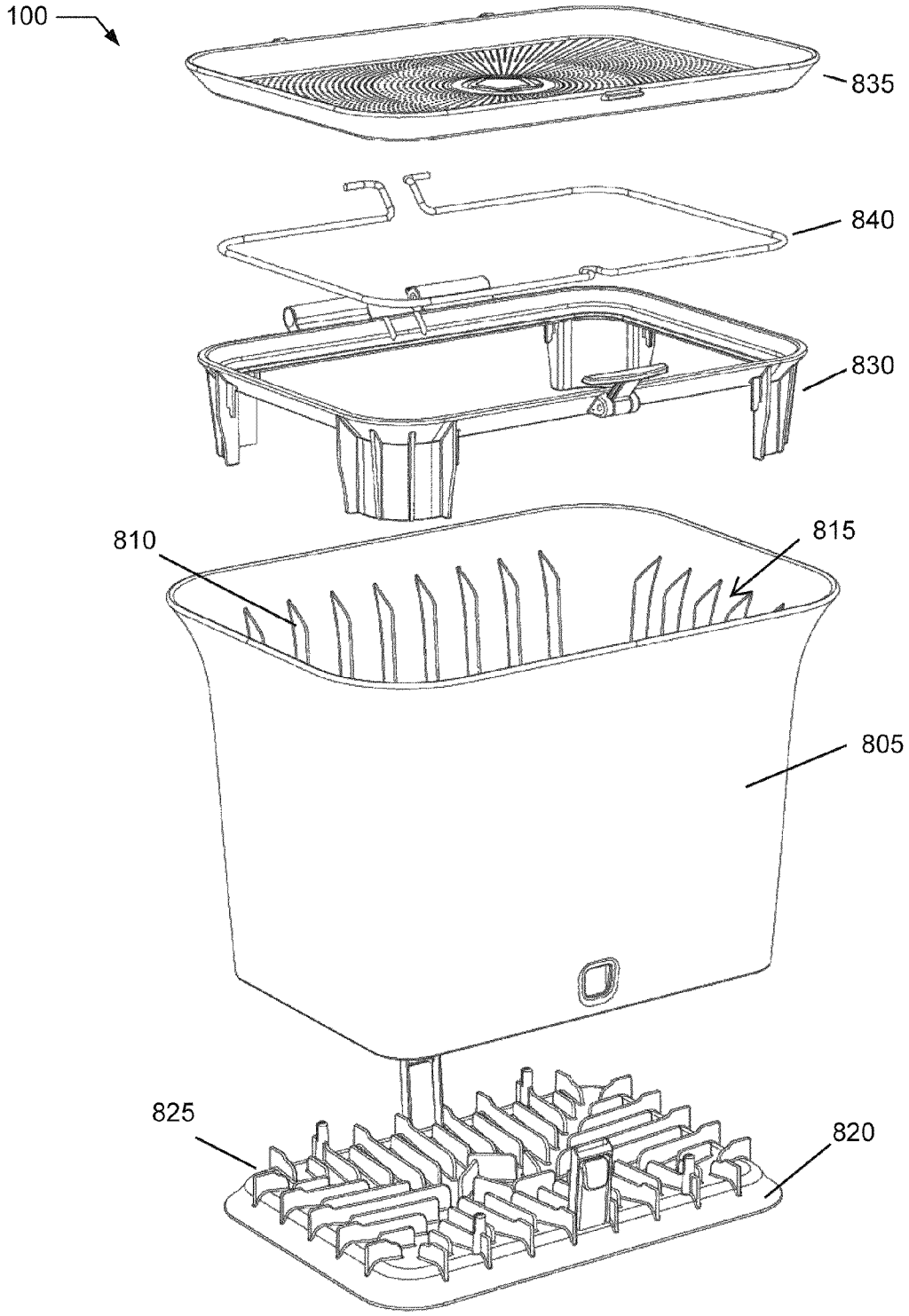
FIG. 8 illustrates an expanded disassembled plan layout of components thereof.

FIG. 8 illustrates an expanded disassembled plan layout of components of countertop compost collector 100. Collector 100 includes a sidewall 805 enclosing a volume and having a top opening and a bottom opening. Provided on an inside surface of sidewall 805 are a plurality of support ribs 810 that extend substantially vertically along a length of sidewall 805 (from near the bottom opening to near the top opening). Between adjacent support ribs 810 a chute 815 is formed, that extends the length of the support ribs.

A bottom 820 joins to the bottom opening and includes an arrangement of support structures 825 that define (by forming spaces or the like), when bottom 805 is joined to sidewall 805, one or more bottom orifices communicated to chutes 815.

A retaining rim 830 joins to the top opening in such a way that it defines, when rim 830 is joined to sidewall 805, one or more top orifices communicated to chutes 815. Rim 830 has a perimeter sized to generally match a perimeter of a collection bag placed inside the volume defined by sidewall 805. The top opening has a perimeter larger than the perimeter of retaining rim 830 and this difference in length provides the one or more top orifices.

A lid 835 is, in the preferred embodiment, sized to match the perimeter of retaining rim 830 rather than the perimeter of the top opening which keeps the top orifice(s) clear of obstruction. The preferred embodiment includes an optional retaining bail 840 that clamps to rim 830 (with a mouth of the collection bag therebetween) to retain the collection bag upright within the volume and to maintain the mouth open and accessible when lid 835 is open.

Figure 9:
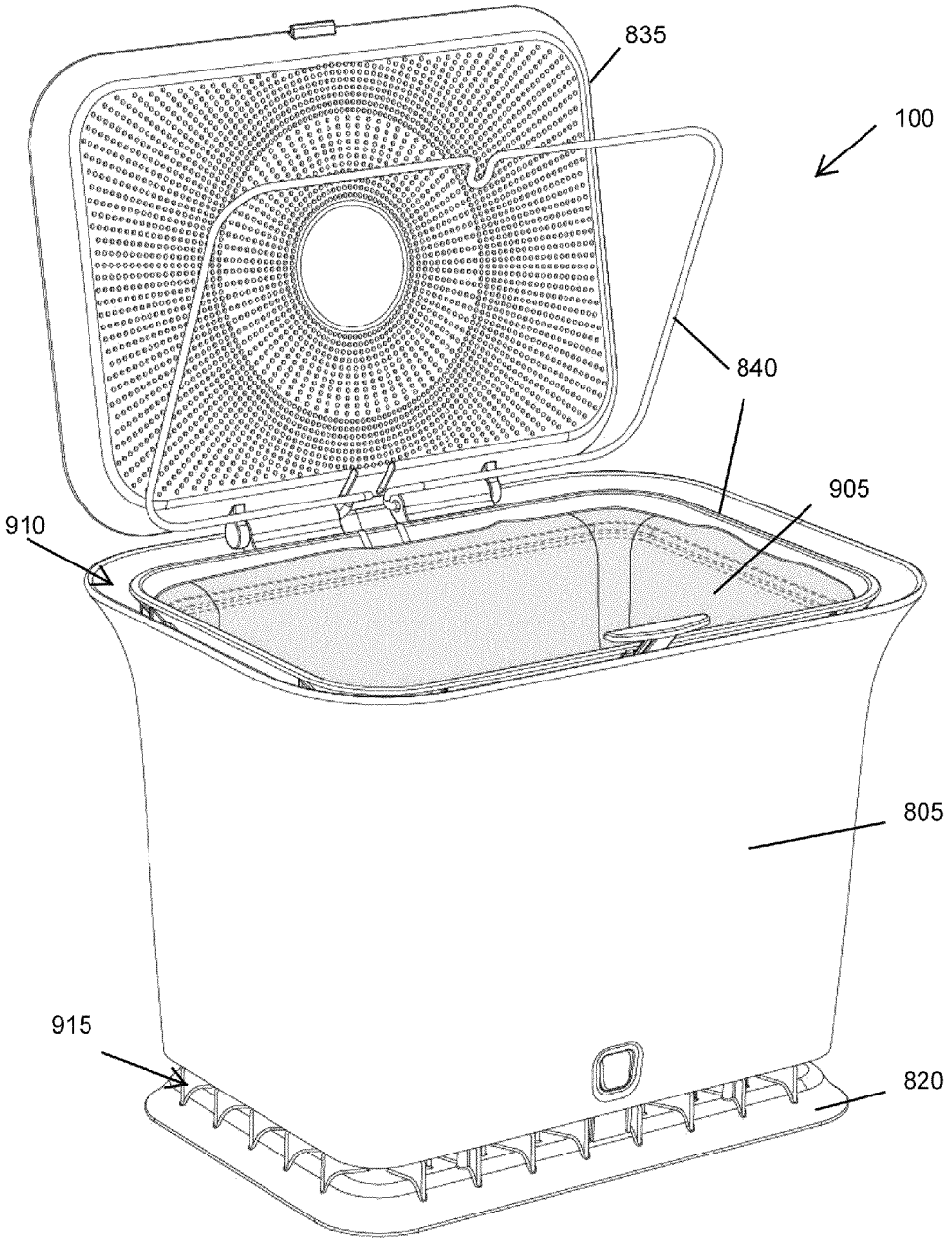
FIG. 9 illustrates an assembled plan view of the countertop compost collector including a retained collection bag.

FIG. 9 illustrates an assembled plan view of the countertop compost collector 100 including a retained collection bag 905 and one or more top orifices 910 and one or more bottom orifices 915. (Note in FIG. 9, bail 840 is shown in two different configurations (though collector 100 includes a single bail 840 in its preferred implementation). This is done to show the interior and open/close mode for bail 840 as an aid to the reader.)

Placing bag 905 within sidewall 805 with the mouth of bag 905 either "stretched" over rim 830 or otherwise overlapping and clamping bail 840 to rim 830 to capture the mouth of bag 905, maintains the mouth open and retains bag 905 upright (in the preferred embodiment bag 905 "hangs" from rim 830). Bag 905 cooperates with chutes 815 to form air channels extending between top orifice(s) 910 and bottom orifice(s) 915. Through this expedient, air actively circulates around contents of bag 905 and inhibits any anaerobic decomposition.

In the preferred embodiment, bag 905 is a biodegradable/compostable bag, permitting bag 905, when filled, to be removed from collector 100, closed, and added to a compost pile or put into a "green" recycling process. Most preferably, bag 905 includes microperforations to enhance aerobic processes and to discourage anaerobic decomposition. For example, BioBag® (made from Mater-Bi that is produced by Novamont, an Italian research company) available from Bio-Group USA of Palm Harbor, Fla., is a preferred collection bag for use with collector 100.

The components of collector 100 are preferably made from environmentally friendly resources, such as a blend of melamine and bamboo waste. The contained volume is preferably about 2.5 gallons. Of course, other materials and volumes are within the scope of the present invention. By providing the top and bottom orifices as described, collector 100 appears to be a sealed container and may be decorated and designed to fit into the household environment without appearing to be a "compost" related device which may detract from its acceptance by some otherwise would-be users. The air channels, provided from fully or partially closed chutes, promote all-around air flow.

As noted herein, the system and process are most preferably implemented in cooperation between a collection bag and a collection device that provides air circulation channels when the bag is used in the device, with orifices at a top and a bottom opening communicating to each other through these channels to enhance air flow (and reduce anaerobic decomposition) of materials placed inside the bag.

The system and methods above has been described in general terms as an aid to understanding details of preferred embodiments of the present invention. Other preferred embodiments of the present include the described application for organic waste collection. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A collection container for use with a collection bag having a bag opening and a bag perimeter length of a bag opening perimeter around the bag opening, comprising:

a continuous substantially vertical side wall, said side wall having an inner surface defining a volume generally matching a volume of the collection bag, said volume having a top opening and a bottom opening, said top opening having a top opening perimeter length of a top perimeter around said top opening, said inner surface including a plurality of substantially vertically-extending support ribs provided on said inner wall defining a plurality of substantially vertical chutes extending from said bottom opening to said top opening inside said volume, said plurality of support ribs configured to define for each vertical chute a chute bottom at said bottom opening and a chute top at said top opening wherein each said vertical chute includes a chute channel extending along a chute length inside said volume from said chute bottom to said chute top with each said chute channel open to said volume along said chute length;

a bottom joined to said side wall and closing said bottom opening, said bottom including one or more bottom spacers defining one or more bottom ports at said bottom opening with said one or more bottom ports communicated to said chute channels; and a retaining rim joined to said side wall at said top opening with said retaining rim defining a rim perimeter length of a rim perimeter around said retaining rim sized to generally match the bag perimeter length, wherein said rim perimeter length is less than said top opening perimeter length with said retaining rim disposed inside said volume providing a top opening space between said rim perimeter and said top opening perimeter inside said volume, and wherein each said chute top is in fluid communication with said top opening space;

wherein said retaining rim is configured to suspend the collection bag inside said volume from said retaining rim perimeter to produce a suspended collection bag inside said volume; and wherein each said chute top is disposed between the suspended collection bag and said inner surface; and further comprising a lid having a lid perimeter length of a lid perimeter around said lid wherein said lid perimeter length is greater than or equal to said rim perimeter length and wherein said lid perimeter length is less than said top opening perimeter length.

2. The collection container of claim 1 further comprising a retaining bail pivotally coupled to said retaining rim and generally matching said rim perimeter of said retaining rim and configured to secure the bag opening perimeter to said rim perimeter when the collection bag is suspended inside said volume.

3. The collection container of claim 1 wherein said lid is pivotally coupled to said retaining rim.

4. The collection container of claim 3 further comprising a retaining bail pivotally coupled to said retaining rim and generally matching said rim perimeter of said retaining rim and configured to secure the bag opening perimeter to said rim perimeter when the collection bag is suspended inside said volume.

5. The collection container of claim 1 wherein said one or more bottom spacers include a plurality of bottom ribs extending from said base towards said volume and configured to support the suspended collection bag while defining a plurality of substantially horizontal air channels below the suspended collection bag.

6. The collection container of claim 1 wherein said chute channels are distributed uniformly around the inside surface and wherein each said chute channel has a substantially uniform chute cross-section with said chute channels.

7. A countertop compost collector supporting a collection bag, comprising:

a sidewall having a top opening and a bottom opening, said sidewall enclosing a volume wherein a plurality of support ribs extend substantially vertically along a length of said sidewall from near said bottom opening to near said top opening, said plurality of support ribs defining pairs of adjacent ribs wherein a a chute is formed between said pairs of adjacent ribs, said plurality of chutes extending around a perimeter of said sidewall;

a bottom coupled to said sidewall closes said bottom opening, said bottom including a plurality of space-forming support structures communicated to said plurality of chutes, said plurality of space forming support structures defining a plurality of lateral openings proximate said bottom opening and defining a plurality of top openings arrayed across a top surface of said bottom;

a retaining rim coupled to said sidewall at said top opening and defining one or more top chute exits communicated to said plurality of chutes, said retaining rim including a lateral perimeter supported by a plurality of downward extending structures that engage an interior of said sidewall forming a spaced-apart gap between said retaining rim and said top opening of said sidewall and produce said one or more top chute exits disposed inside said volume wherein said lateral perimeter is smaller than a perimeter of said top opening and wherein said retaining rim includes a retaining rim opening; and a lid sized smaller than said perimeter of said top opening and at least as large as said lateral perimeter of said retaining rim providing said one or more top chute exits unobstructed when said lid is closed and covering said retaining rim opening.

8. The countertop collector of claim 7 further comprising a bail pivotally coupled to said retaining rim configured to include a clamping mode configured to engage a mouth of the collection bag and said lateral perimeter of said retaining rim maintaining the collection bag upright within said volume and accessible when said lid uncovers said retaining rim opening;

wherein said plurality of air channels are closed along said length and open at said bottom opening and said top opening whether said lid is open or closed.

* * * * *